US008596771B2

(12) United States Patent
Takagi et al.

(10) Patent No.: US 8,596,771 B2
(45) Date of Patent: Dec. 3, 2013

(54) PRINTING-LIQUID CARTRIDGE AND RECORDING APPARATUS USING THE SAME

(75) Inventors: Yuki Takagi, Nagoya (JP); Tomohiro Kanbe, Nagoya (JP); Hirotake Nakamura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 30 days.

(21) Appl. No.: 13/335,566

(22) Filed: Dec. 22, 2011

(65) Prior Publication Data

US 2012/0249691 A1 Oct. 4, 2012

(30) Foreign Application Priority Data

Mar. 30, 2011 (JP) ..... 2011-074230
Sep. 30, 2011 (JP) ..... 2011-218030

(51) Int. Cl.
*B41J 2/175* (2006.01)

(52) U.S. Cl.
USPC ..... 347/86

(58) Field of Classification Search
USPC ..... 347/49, 85, 86
See application file for complete search history.

(56) References Cited

U.S. PATENT DOCUMENTS 5,971,534 A * 10/1999 Sasaki et al. ..... 347/86
6,767,075 B1 7/2004 Takada et al.
7,484,825 B2 * 2/2009 Asauchi ..... 347/19
8,215,754 B2 * 7/2012 Akiyama ..... 347/85
8,292,414 B2 * 10/2012 Hayakawa et al. ..... 347/85
2008/0239036 A1 10/2008 Hattori
2009/0322837 A1 12/2009 Muhl
2010/0085404 A1 4/2010 Akiyama

FOREIGN PATENT DOCUMENTS

EP 0412459 A2 2/1991
EP 0698497 A2 2/1996
EP 1550558 A1 7/2005
EP 1790480 A1 5/2007
EP 2080620 A1 7/2009
EP 2233301 A1 9/2010
JP 2008-110577 A 5/2008

OTHER PUBLICATIONS

European Patent Office, extended European Search Report for European Patent Application No. 11195228.9 (counterpart to above-captioned patent application), dated Mar. 23, 2012.

* cited by examiner

*Primary Examiner* — Anh T. N. Vo
(74) *Attorney, Agent, or Firm* — Baker Botts L.L.P.

(57) ABSTRACT

A print liquid cartridge comprising a print liquid chamber, print liquid supply portion, a stopper, and a release member. The print liquid supply portion establishes a communication between an interior of the print liquid chamber and an exterior of the print liquid chamber. The stopper prevents the printing-liquid cartridge from moving in a direction opposite to the liquid communication direction. The release member releases the stopper, such that the printing-liquid cartridge is permitted to move in a direction opposite to the fluid outflow direction. The stopper is aligned with the release member in a height direction orthogonal to the liquid communication direction and a width direction.

20 Claims, 11 Drawing Sheets

PRINTING-LIQUID CARTRIDGE AND RECORDING APPARATUS USING THE SAME

CROSS REFERENCE TO RELATED APPLICATION

This application claims priorities from Japanese Patent Application No. 2011-074230 filed Mar. 30, 2011 and Japanese Patent Application No. 2011-218030 filed Sep. 30, 2011. The entire contents of these applications are incorporated herein by reference.

TECHNICAL FIELD

The present invention relates to a printing-liquid cartridge that is mountable into and removable from a cartridge mounting portion, and to a recording apparatus having the cartridge mounting portion and printing-liquid cartridge.

BACKGROUND

A known image recording apparatus of a so-called tube-supply system has an ink cartridge that is positioned on the outside of a carriage on which a recording head is mounted, and the ink cartridge and the recording head are connected via a tube. The ink cartridge is configured to insert horizontally into an opening of a cartridge mounting portion positioned in the front of the image recording apparatus. The cartridge may be inserted into and removed from the cartridge mounting portion. When the ink cartridge is inserted into the cartridge mounting portion, an ink channel extending from the ink cartridge to the recording head is formed.

The cartridge mounting portion may include a hollow needle or the like, which is referred to as an "ink needle," such that the ink stored in the ink cartridge is supplied to the recording head via the tube.

The mounting portion may include a locking mechanism configured to retain the ink cartridge in its mounted state and a biasing member configured to bias the ink cartridge toward the opening of the cartridge mounting portion.

In this manner, a reduction in size of the recording apparatus is constrained by an arrangement of the locking mechanism in the cartridge mounting portion.

SUMMARY

In view of these and other shortcomings of the related art, it is an object of the invention to provide the smaller recording apparatus.

According to an aspect of the invention, there is provided a print liquid cartridge comprising a print liquid chamber, print liquid supply portion, an engaging portion, and a release member. The print liquid supply portion may allow the print liquid to flow out of the print liquid chamber in a fluid outflow direction. The engaging portion may include an engaging surface configured to prevent the printing-liquid cartridge from moving in a direction opposite to the fluid outflow direction by contact of the engaging surface with an external object in the direction opposite to the fluid outflow direction. The release member may move relative to the engaging surface between a first position and a second position, the release member being aligned with a lower portion of the engaging surface in the fluid outflow direction when the release member is in the first position. The release member may release the engaging surface from the contact with the external object by moving from the first position to the second position.

According to another aspect of the invention, there is provided a recording apparatus is provided a cartridge mounting portion. The cartridge mounting portion receives therein a print liquid cartridge when the print liquid cartridge is inserted into the cartridge mounting portion in the fluid outflow direction. The cartridge mounting portion may comprise an engaging member which may associate with the stopper of the printing-liquid cartridge, Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawings.

DETAILED DESCRIPTION

Figure 1:
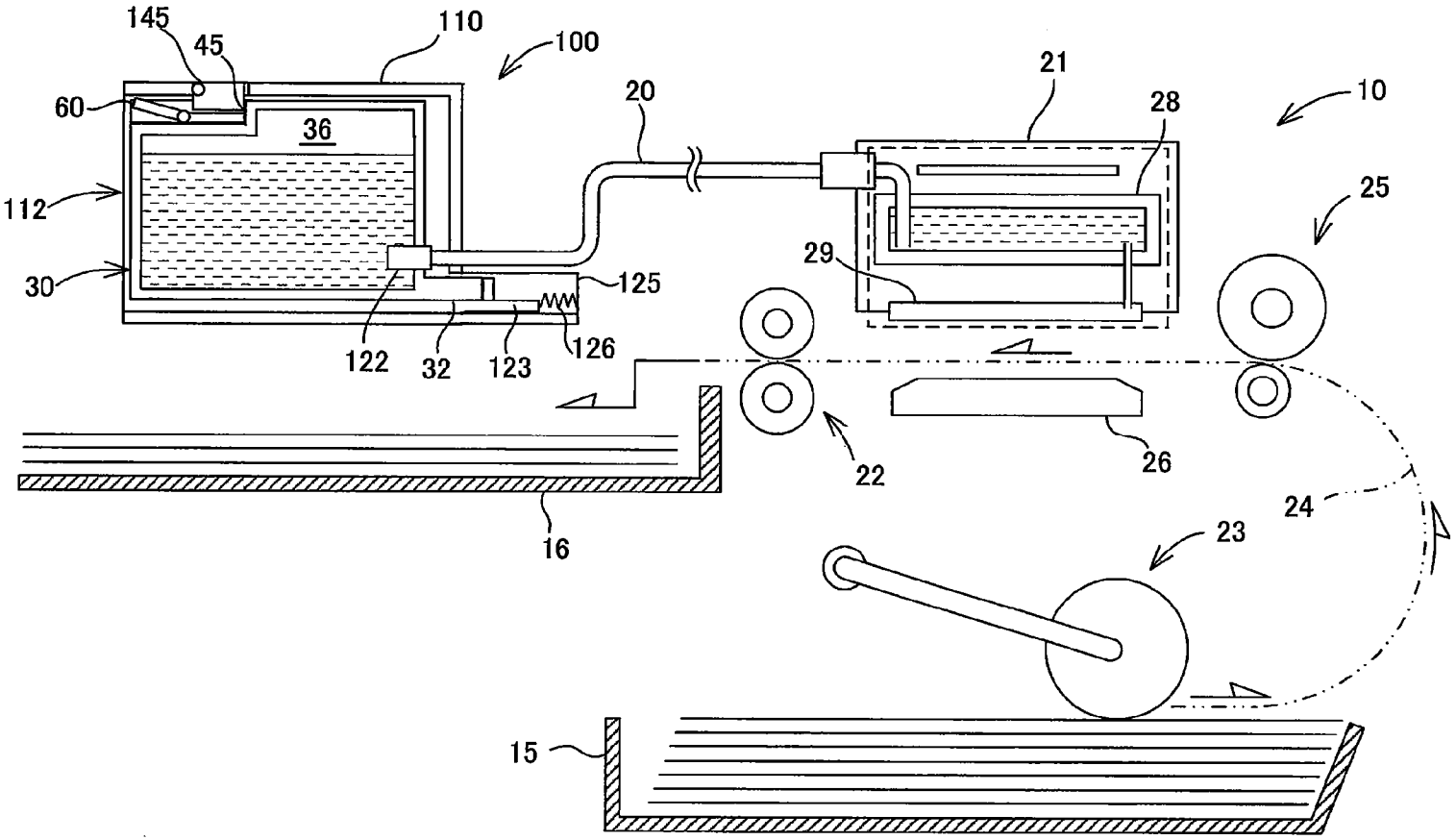
FIG. 1 is a conceptual cross-sectional view showing an internal structure of a printer provided with a cartridge mounting unit according to an embodiment of the invention.

Embodiments of the present invention, and their features and advantages, may be understood by referring to FIGS. 1-11, like numerals being used for like corresponding parts in the various drawings. The embodiments described below are examples only, and the embodiments may be modified as needed without changing the scope of the invention.

An ink cartridge 30 according to an embodiment of the present invention will be described with reference to FIGS. 1 through 6B.

<Overview of a Printer 10>

First, a printer 10 in which the ink cartridge 30 is accommodated will be described with reference to FIG. 1. The ink cartridge 30 corresponds to the printing-liquid cartridge. The printer 10 corresponds to the recording apparatus. The terms "upward", "downward", "upper", "lower", "above", "below", "beneath", "right", "left", "front", "rear" and the like will be used throughout the description assuming that the printer 10 is positioned in an orientation in which it is intended to be used.

The printer 10 uses an inkjet recording system to record images by selectively ejecting ink droplets onto a recording paper. As shown in FIG. 1, the printer 10 may comprise an ink supply device 100. The ink supply unit 110 may comprise a cartridge mounting unit 110. The cartridge mounting unit 110 allows the ink cartridge 30 to be mounted therein. The cartridge mounting unit 110 includes an opening 112 which opens toward the outside on one surface of the image recording apparatus 10. The ink cartridge 30 may be configured to be inserted into the cartridge mounting unit 110 and removed from the cartridge mounting unit 110 through the opening 112. The ink cartridge 30 is inserted into or removed from the cartridge mounting unit 110 through the opening 112.

Ink is stored in the ink cartridge. A recording head 21 may connect to the ink cartridge 30 via an ink tube 20. The recording head 21 may have a sub-tank 28 in which temporarily stores ink supplied through the ink tube 20. The recording head 21 may include a plurality of nozzles 29 through which ink supplied from the sub-tank 28 may selectively eject to form a recording image.

The printer 10 also may comprise a paper tray 15, a sheet supply roller 23, a sheet passage 24, a pair of transfer rollers 25, a platen 26, a pair of discharge roller 22, and a paper discharge tray 16 arranged in this order along a feed direction. The sheet supply roller 23 may supply the sheet from the paper feed tray 15 to the sheet passage 24; and the pair of transfer rollers 25 may further convey the sheet to the platen 26. Then, the recording head 21 may selectively eject the ink onto the sheet passing through the platen 26 to form an image on the sheet. The pair of discharge rollers 22 then may discharge the sheet onto the discharge tray 16.

Note that the general structure of the printer 10 according to the preferred embodiment is merely one example. Obviously the printer 10 may employ other constructions used in inkjet printers known in the art, such as different methods for feeding and conveying the recording paper and a different shape for the conveying path.

<Ink Supply Device 100>

As shown in FIG. 1, the ink supply device 100 is provided in the printer 10. The ink supply device 100 functions to supply ink to the recording head 21 provided in the printer 10. The ink supply device 100 includes the cartridge mounting unit 110 in which the ink cartridge 30 may be inserted. FIG. 1 shows the cartridge mounting unit 110 when the ink cartridge 30 is mounted therein.

<Ink Cartridge 30>

Figure 2:
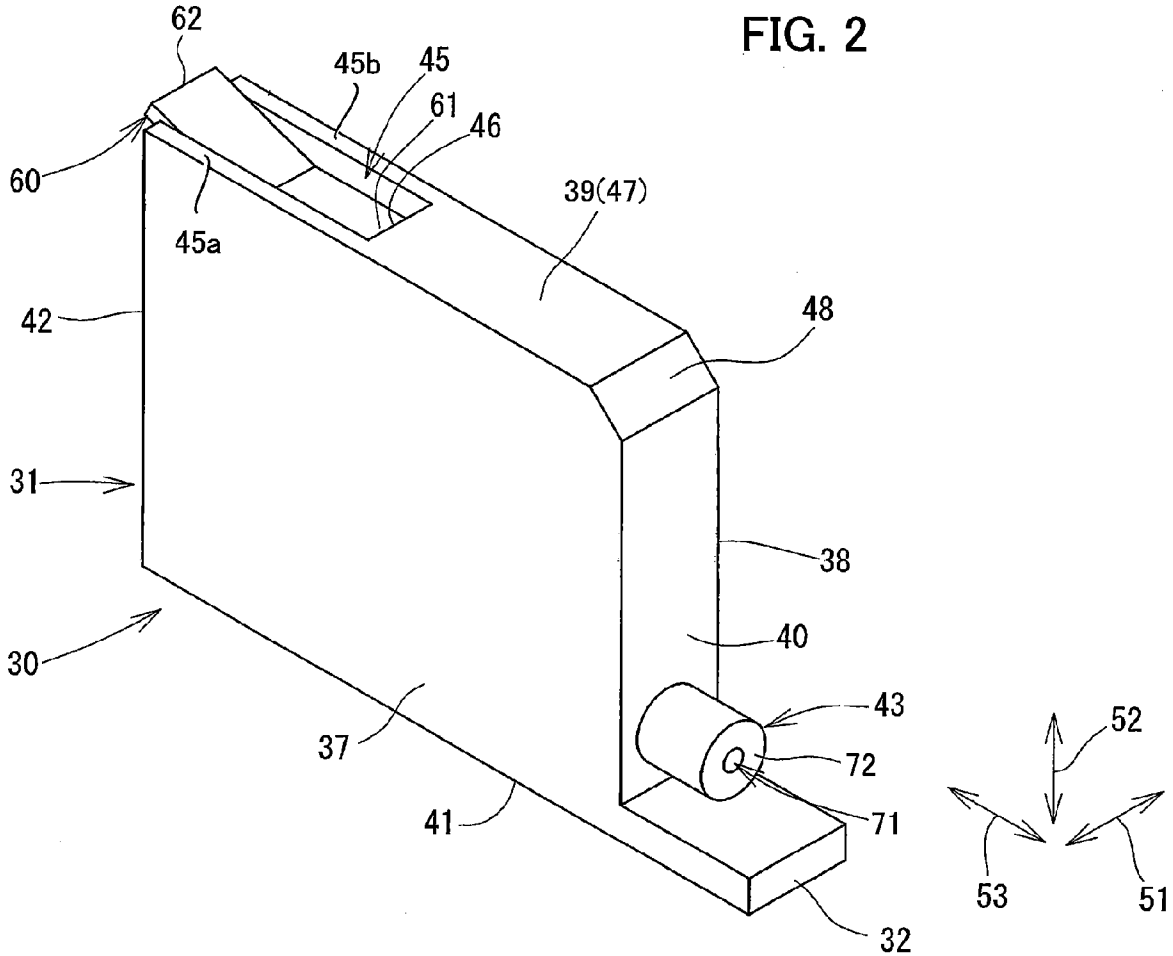
FIG. 2 is a perspective view of an ink cartridge.
Figure 3:
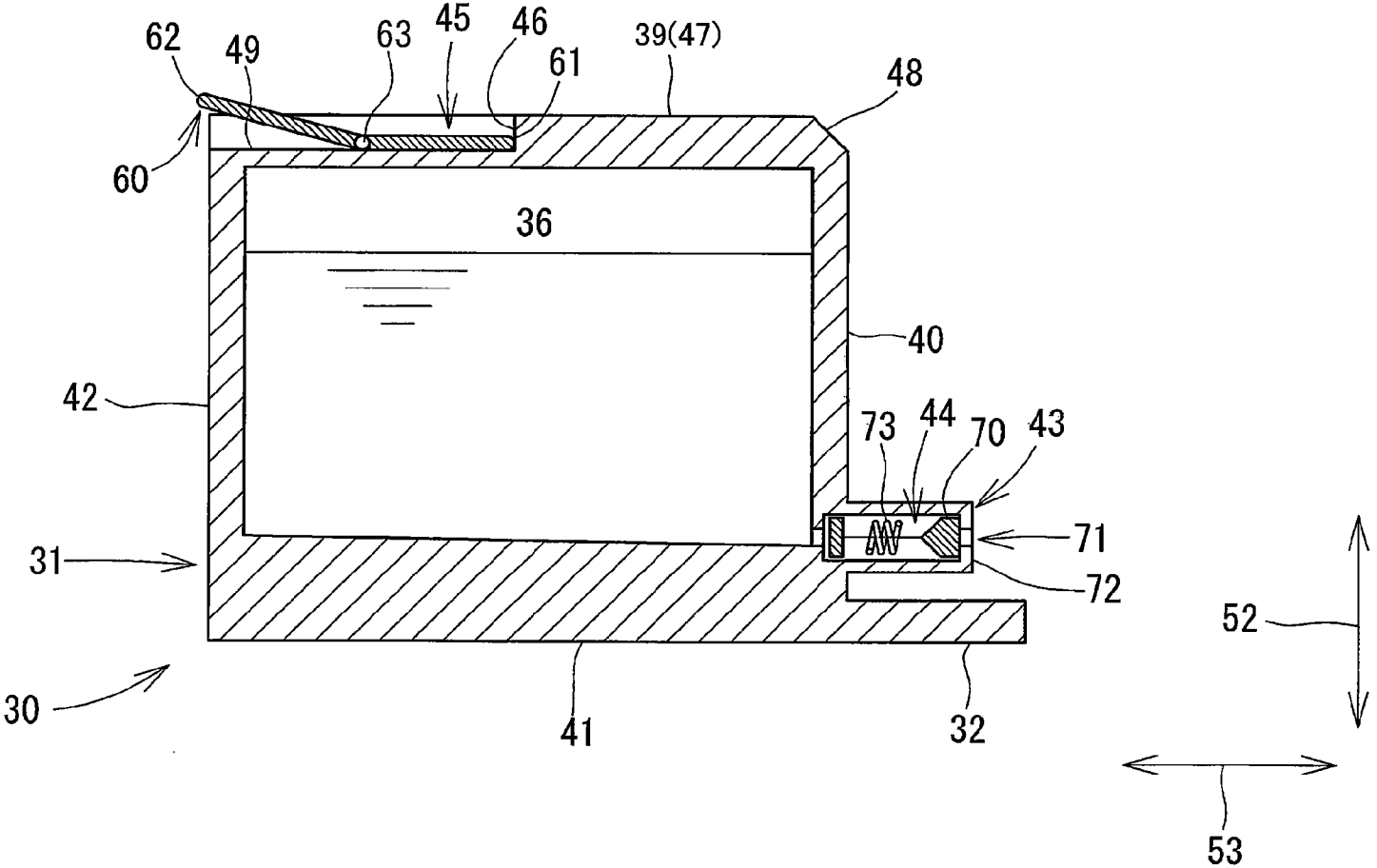
FIG. 3 is a vertical cross-sectional view showing an internal structure of the ink cartridge of FIG. 2.

Next, a detailed configuration of the ink cartridge 30 will be described. As shown in FIG. 3, the ink cartridge 30 defines therein an ink chamber 36 in which the ink is stored. As shown in FIGS. 2 and 3, the ink cartridge 30 has a casing 31 defining an outer shell of the ink cartridge 30. The ink chamber 36 may be defined inside the casing 31, or may be defined by a member separate from the casing 31 but inside the casing 31. The ink chamber 36 corresponds to the print liquid chamber. The casing 31 corresponds to the body and the casing.

The ink cartridge 30 may be configured to be installed in and removed from the cartridge mounting unit 110 in an upright position shown in FIG. 2, i.e. along a direction indicated by an arrow 53 with a lower surface in the drawing as a bottom surface and an upper surface in the drawing as an upper surface (hereinafter, referred to as an "insertion and removal directions 53"). Hereinafter, a description will be given assuming that the ink cartridge 30 is in the upright position.

As shown in FIG. 2, the casing 31 may have a generally flat, rectangular shape with a widthwise in a direction indicated by an arrow 51 (herein after, referred to as a widthwise direction or a horizontal direction), a height in a direction indicated by an arrow 52 that is perpendicular to the widthwise direction 51 (hereinafter, referred to as a vertical direction or a height direction) and a depth in a direction indicated by an arrow 53 that is perpendicular to the vertical direction and widthwise direction 51 (hereinafter, referred to as a depthwise direction 53). The height of casing 31 and the depth of casing 31 are each greater than the width of casing 31. In other words, in the upright position, the depthwise direction 53 is parallel to the insertion direction 56 and the removal direction 55, while the widthwise direction 51 and height direction 52 are respectively orthogonal to the insertion direction 56 and the removal direction 55.

As shown in FIG. 2, the casing 31 may have a front wall 40, a rear wall 42, a pair of side walls 37, 38, a top wall 39, and a bottom wall 41. The front wall 40 is positioned at the front side of the printer 10 when the ink cartridge 30 is inserted into the cartridge mounting unit 110, and the rear wall 42 of the ink cartridge 30 is inserted into the cartridge mounting unit 110, and the rear wall 42 of the casing 31 is positioned on the rear side of the casing 31. The front wall 40 and rear wall 42 may be positioned opposite to each other in the depthwise direction 53 (in the insertion direction 56). Four walls may separate the front wall 40 from the rear wall 42: a pair of side walls (not depicted) extending in the insertion and removal directions 50, an upper wall 39 connecting the upper edges of the side walls, and a lower wall 41 also connecting the lower edges of the side walls. The upper wall 39 and lower wall 41 are spaced away from each other by a prescribed distance in the height direction 52. The front wall 40 corresponds to the front side. The rear wall 42 corresponds to the rear side. The top wall 39 corresponds to the upper side of the present invention.

An ink supply portion 43 may be positioned on the front side of the ink cartridge 30, e.g., the front wall 40 of the casing 31 at a lower end. The ink supply portion 43 may have cylindrical outer shape, and ink supply portion 43 may project frontward from the front wall 40 in the insertion direction 56 (i.e., in the depthwise direction 53). The ink supply portion 43 may have an outer end portion 72 on which an ink supply outlet 71 is formed to provide external communication with the casing 31.

As shown in FIG. 3, an ink channel 44 may be formed to extend from the ink supply outlet 71 through an internal space of the ink supply portion 43 to the ink chamber in the depthwise direction 53. The ink supply portion 43 corresponds to the print liquid supply portion.

As shown in FIG. 3, within the ink supply portion 43, a valve 70 may be configured to be opened or closed by the ink supply outlet 71. The valve 70 may move within the ink channel 44 of the ink supply portion 43 in the depthwise direction 53 (in the insertion direction 56 as well as in the removal direction 55). A coil spring 73 may be provided for biasing the valve 70 toward the ink supply outlet 71. When no external forces may be applied to the valve 70, the coil spring 73 holds the valve 70 in a closed position for tightly sealing the ink supply outlet 71. A portion of the outer end portion 72 of the ink supply portion 43 surrounding the ink supply outlet 71 is formed of an elastic member, such as rubber. The elastic member elastically may deform when contacted by the valve 70 biased by the coil spring 73, tightly sealing the ink supply outlet 71. In this state, part of the valve 70 may be exposed through the ink supply outlet 71 outside of the ink supply portion 43, i.e., outside the ink cartridge 30. The ink supply portion 71 is not limited to a configuration in which the ink supply valve 70 opens and closes the ink supply portion 70. For example, a configuration in which a film, rubber stopper, or the like closes the ink supply outlet 70 when the ink cartridge inserted into the cartridge mounting unit 110.

An ink needle 122 (described later) may be also positioned on the cartridge mounting unit 110. When the ink cartridge 30 is mounted in the cartridge mounting unit 110, the ink needle 122 is inserted into the ink supply outlet 71, elastically deforming the coil spring 73 and moving the valve 70 against the biasing force of the coil spring 73 into an open position separated from the ink supply outlet 71 (see FIG. 6A). In this state, the ink supply outlet 71 is open and ink in the ink chamber 36 can flow into the ink needle 122 through the ink channel 44.

An air introducing unit (not shown) may also be provided in the casing 31. Accordingly, air is introduced into the ink chamber 36 via the air introducing unit as ink flows from the ink chamber 36 into the ink needle 122. However, the air introducing unit is not an essential component. For example, the ink chamber 36 may be configured of an ink bag whose volume decreases as the amount of ink in the ink chamber 36 decreases.

As shown in FIGS. 2 and 3, a protrusion 32 may be positioned on the lower wall 41 (a lower end of the front wall 40 below the ink supply portion 43). The protrusion 32 may protrude frontward in the insertion direction 56 and may have a protruding length greater than that of the ink supply portion 43 in the insertion direction 56.

As shown in FIGS. 2 and 3, the top wall 39 of the casing 31 may be formed with an engaging recess 45 extending from a position substantially center of the top wall 39 to the rear wall 42 in the depthwise direction 53. The engaging recess 45 may be defined by a vertical engaging surface 46 at the front end in the insertion direction 56, and a pair of ribs 45*a*, 45*b*. That is, the engaging surface 46 may occupy a plane extending in the widthwise direction 51 and the height direction 52. When the ink cartridge 30 is mounted in the cartridge mounting unit 110, an engaging member 145 of the cartridge mounting unit 110 (described later) may engage the engaging surface 46. Specifically, the engaging member 145 engages the top end of the engaging surface 46. The top end of the engaging surface 46 corresponds to the stopper.

As shown in FIGS. 2 and 3, a portion of the upper wall 39 that may be positioned frontward of the engaging recess 45 in the insertion direction 56 serves as a upper surface 47 that may contact the engaging member 145 of the cartridge mounting unit 110 when the ink cartridge 30 is inserted into the cartridge mounting unit 110. That is, the upper surface 47 may have a plane extending in the widthwise direction 51 and the depthwise direction 53. The top surface 47 and front wall 40 may be linked by a sloped surface 48 sloping relative to the top surface 47 and front wall 40. The sloped surface 48 serves to guide the engaging member 145 onto the top surface 47. However, the sloped surface 48 may be omitted from this construction. Alternatively, a protrusion similar to the protrusion 32 that protrudes in the insertion direction 56 may be provided in place of the sloped surface 48.

As shown in FIGS. 2 and 3, a pivotal member 60 is provided in the engaging recess 45. The pivotal member 60 has a bent plate shape and extends in the depthwise direction 53. Specifically, the pivotal member 60 has a first arm 61, a second arm 62, and a shaft 63 extending in the widthwise direction 51. The shaft 63 is pivotal-movably supported by the top wall 39 at the rearward of the engaging surface 46. The first arm 61 radially may extend from the shaft 63 frontward at the vicinity of or on the engaging surface 46. The second arm 62 also radially may extend rearward from the shaft 63 over the rear wall 42. With this construction, the pivotal member 60 may be pivotally moved about the shaft 63. Note that the casing 31 and the pivotal member 60 may be integrally formed. The pivotal member 60 corresponds to the release member and the lever.

While an external force (described later) may be not being applied to the pivotal member 60, the first arm 61 may contact a bottom surface 49 of the engaging recess 45 due to its self-weight or a biasing force of a biasing member, e.g., coil spring (not shown). On the other hands, when the second arm 62 may be pushed downward against the weight or the biasing force, the pivotal member 60 may pivot about the shaft 63 in a counterclockwise direction in FIG. 3, thereby the first arm 61 is moved away from the bottom surface 49.

<Cartridge Mounting Unit 110>

Figure 4:
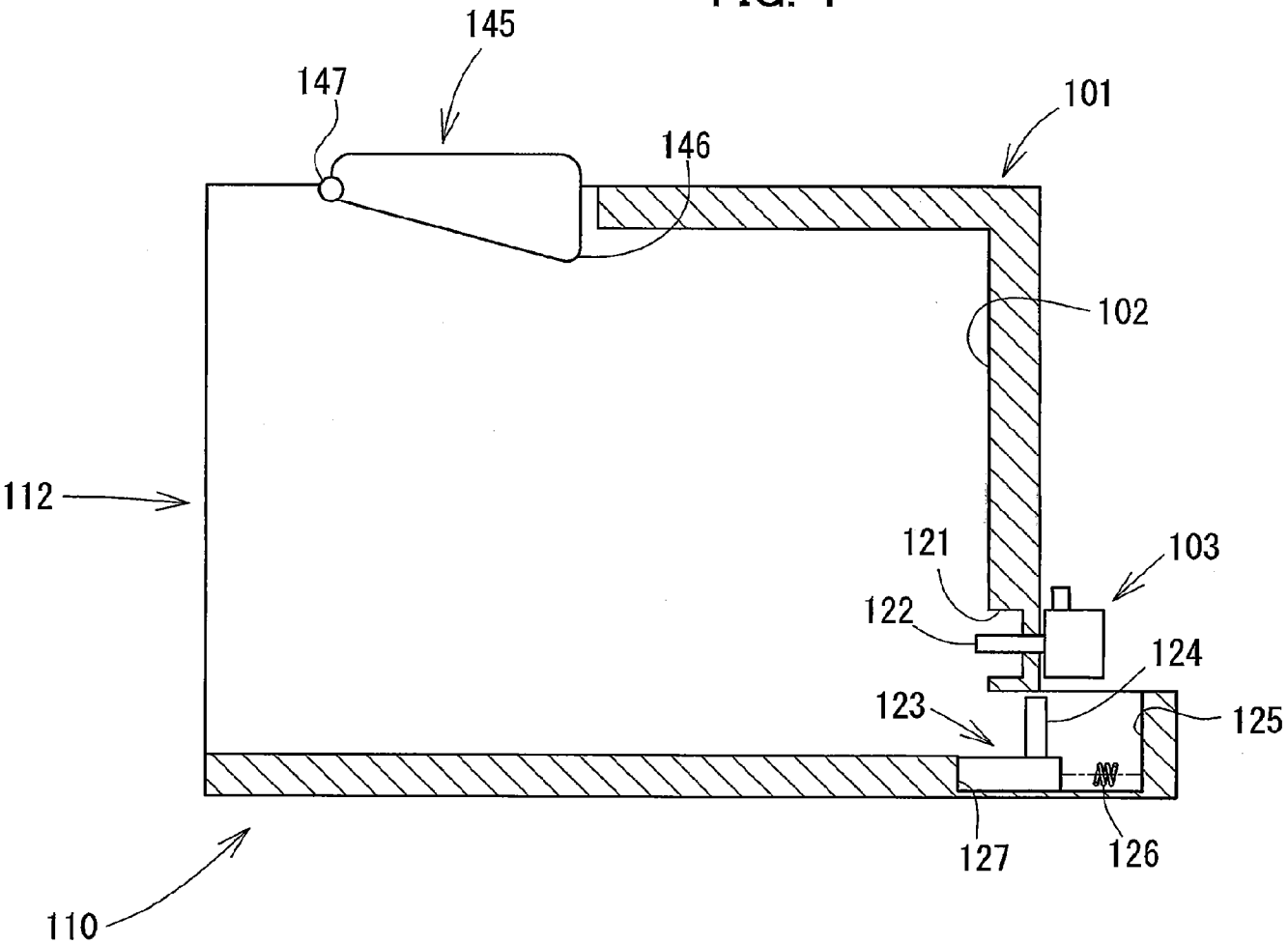
FIG. 4 is a vertical cross-sectional view of a cartridge mounting unit.

As shown in FIG. 4, the cartridge mounting unit 110 may have a case 101 forming its box-like outer shell. The case 101 has an opening 112. The ink cartridge 30 may be inserted into or removed from the case 101 through the opening 112. The case 101 may be capable of accommodating a plurality of the ink cartridge 30, e.g. four ink cartridges 30 corresponding to the colors cyan, magenta, yellow, and black. However, in the drawings, the cartridge mounting unit 110 is illustrated such that the case 101 can accommodate only one ink cartridge 30.

The case 101 may have an end surface 102 that faces an internal space of the case 101 and may be positioned on the opposite side of this internal space from the opening 112 in the insertion direction 56. As shown in FIG. 4, a connector 103 may be positioned at a lower portion of a side wall constituting the case 101 on which the end surface 102 is formed. If the case 101 accommodates a plurality of ink cartridges 30, a plurality of connectors 103 may be positioned.

The connector 103 may include the ink needle 122 and a retaining part 121. While not illustrated in FIG. 4, the ink needle 122 may be connected to the ink tube 20 on an outer surface of the side wall that has the end surface 102. The ink tube 20 connected to each ink needle 122 is also connected to the recording head 21 of the printer 10 and is capable of delivering ink thereto.

Figure 6A:
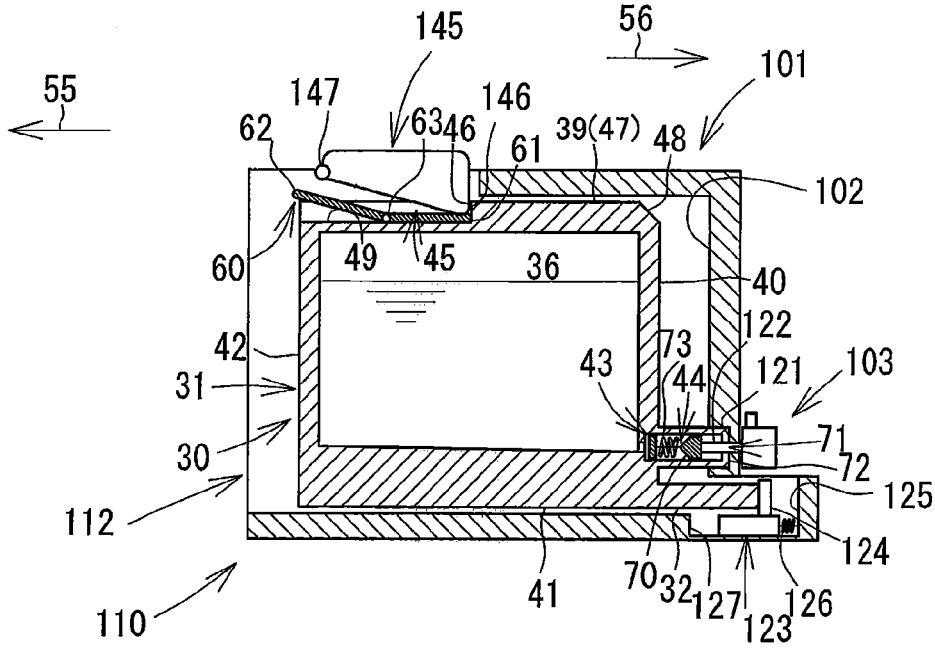
FIG. 6A is a vertical cross-sectional view of the ink cartridge of FIG. 3 mounted on the cartridge mounting unit of FIG. 4, illustrating a state in which the ink cartridge is fully mounted in the cartridge mounting unit.

The retaining part 121 may be formed in the end surface 102 of the case 101 by hollowing out a portion of the end surface 102 in a cylindrical shape. The ink needle 122 may be coaxially disposed at the retaining part 121 and may penetrate through the side wall of case 101 having the end surface 102 in the insertion direction 56. When the ink cartridge 30 may be mounted in the cartridge mounting unit 110, as illustrated in FIG. 6A, the cylindrically-shaped ink supply portion 43 may be hermetically inserted into the cylindrically-shaped retaining part 121. At this time, the outer circumferential surface of the ink supply portion 43 may tightly contact and cohere with the surface defining the retaining part 121. When the ink supply portion 43 is inserted into the retaining part 121, the ink needle 122 is also inserted into the ink supply outlet 71 formed in the ink supply portion 43. The ink needle 122 inserted through the ink supply outlet 71 moves the valve 70 from its closed position to its open position against the biasing force of the coil spring 73. Accordingly, ink stored in the ink chamber 36 may now flow outward. The ink flowing out of the ink chamber 36 may flow into the ink needle 122 due to head difference and the like and is delivered to the recording head 21 via the ink tube 20.

As shown in FIG. 4, the engaging member 145 may be positioned on the case 101. The engaging member 145 may hold the ink cartridge 30 in its mounted state in the cartridge mounting unit 110. The engaging member 145 may be located at a position above the opening 112 formed in the case 101. The engaging member 145 corresponds to the engaging member.

The engaging member 145 may be pivotably supported to the case 101 by a support shaft 147. The support shaft 147 may be provided at one end of the engaging member 145 nearest the opening 112 and may be mounted on the case 101. With this construction, the engaging member 145 may be pivotably supported above and in proximity to the opening 112 of the case 101 and pivots about the support shaft 147 so as to approach or separate from the opening 112. The engaging end 146 may be formed on another end of the engaging member 145 opposite the support shaft 147. The engaging end 146 may be engageable with the engaging surface 46 of the engaging recess 45 formed in the ink cartridge 30. By engaging with the engaging surface 46, the engaging end 146 may hold the ink cartridge 30 in its mounted position relative to the case 101 against a biasing force (described later) applied from the case 101. A position of the engaging member 145 when the engaging end 146 is engaged with the engaging surface 46 (see FIG. 6A) will be referred to as a "locked position," while another position of the engaging member 145 when the engaging end 146 is not engaged in the engaging surface 46 (see FIG. 6B) will be referred to as an "unlocked position."

The engaging end 146 may be biased downward due to one's own weight or a biasing force of a coil spring (not shown) to contact the first arm 61 at the locked position. However, when the first arm 61 is pivotally moved upward, the engaging member 145 is also pivotally moved upward about the support shaft 147, moving from the locked position to the unlocked position. Further, while not illustrated in the drawings, the pivoting range of the engaging member 145 may be restricted so that the engaging member 145 cannot move farther downward than the locked position (the state shown in FIG. 4). Note that, the engaging member 145 is not necessary biased downward. The engaging member 145 may pivotally move downward due to its self-weight even without being biased to realize its engagement with the engaging surface 46 of the ink cartridge 30.

As shown in FIG. 4, the interior space of the cartridge mounting unit 110 may be expanded in the insertion direction 56 beneath the end surface 102. Within this expanded space, a slide member 123 may be movably provided. The slide member 123 may be slidable in the insertion direction 56 and the removal direction 55 (horizontally). The slide member 123 may be generally rectangular parallelepiped in shape. The slide member 123 may have a top surface from which a protruding piece 124 protrudes upward. The protruding piece 124 may stand in an insertion path of the protrusion 32 provided on the ink cartridge 30 so that the protrusion 32 may be abuttable on the protruding piece 124 while the ink cartridge 30 is mounted in the cartridge mounting unit 110.

The expanded space in which the slide member 123 may be accommodated is defined by an end surface 125 and a front surface 127 opposing each other in the insertion direction 56. The slide member 123 may be interposed between the end surface 125 and the front surface 127. A coil spring 126 may be positioned in a compressed state between the end surface 125 and slide member 123 and biases the slide member 123 in the removal direction 55. When an external force may be not applied to the slide member 123, the slide member 123 may be placed in contact with the front surface 127 by the biasing force of the coil spring 126. The front surface 127 may restrict the range of movement of the slide member 123 away from the end surface 125. When the ink cartridge 30 is inserted farther into the cartridge mounting unit 110 after the protrusion 32 of the ink cartridge 30 contacts the protruding piece 124, the slide member 123 may move together with the protruding piece 124 toward the end surface 125, compressing the coil spring 126.

It should be noted that the protrusion 32 may not be provided at the ink cartridge 30. Without the protrusion 32, the ink cartridge 30 may still be applied with a biasing force acting in the removal direction 55 during the mounting process of the ink cartridge 30 into the cartridge mounting unit 110, since the ink cartridge 30 is provided with the coil spring 73 disposed within the ink supply portion 43.

<Mounting the Ink Cartridge>

Next, operations for mounting the ink cartridge 30 in and removing the ink cartridge 30 from the cartridge mounting unit 110 will be described with reference to FIGS. 5A through 6B.

Figure 5A:
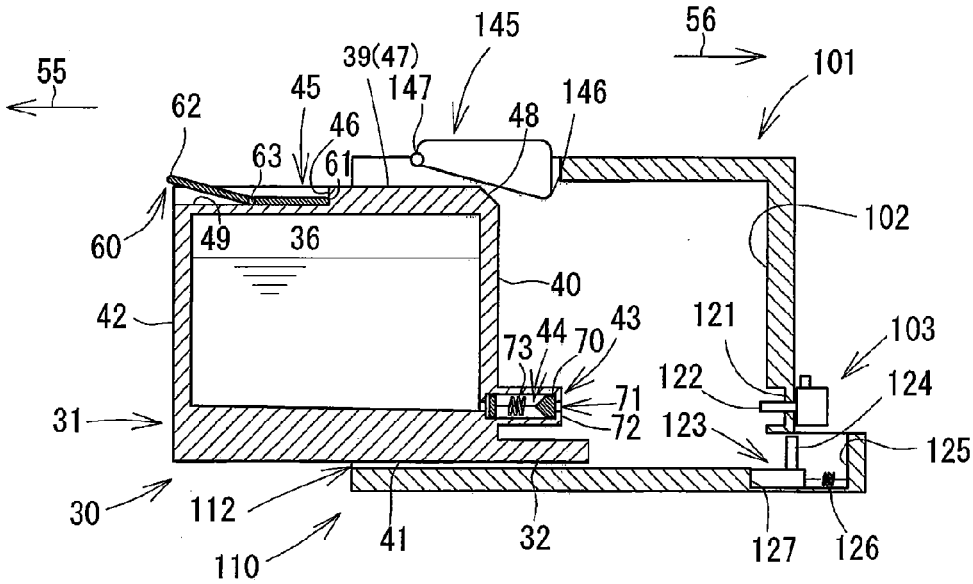
FIG. 5A is a vertical cross-sectional view of the ink cartridge of FIG. 3 mounted on the cartridge mounting unit of FIG. 4, illustrating a state in which the ink cartridge is initially being inserted into the cartridge mounting unit.

As shown in FIG. 5A, the ink cartridge 30 may be inserted into the cartridge mounting unit 110 through the opening 112, leading with the front wall 40 side of the ink cartridge 30. When the ink cartridge 30 is inserted into the cartridge mounting unit 110, the sloped surface 48 of the casing 31 contacts the engaging member 145. As the ink cartridge 30 is farther inserted into the cartridge mounting unit 110, the engaging member 145 slides up the sloped surface 48 onto the upper surface 47. Accordingly, the engaging member 145 may pivot counterclockwise in FIG. 5A, moving from the locked position to the unlocked position.

Figure 5B:
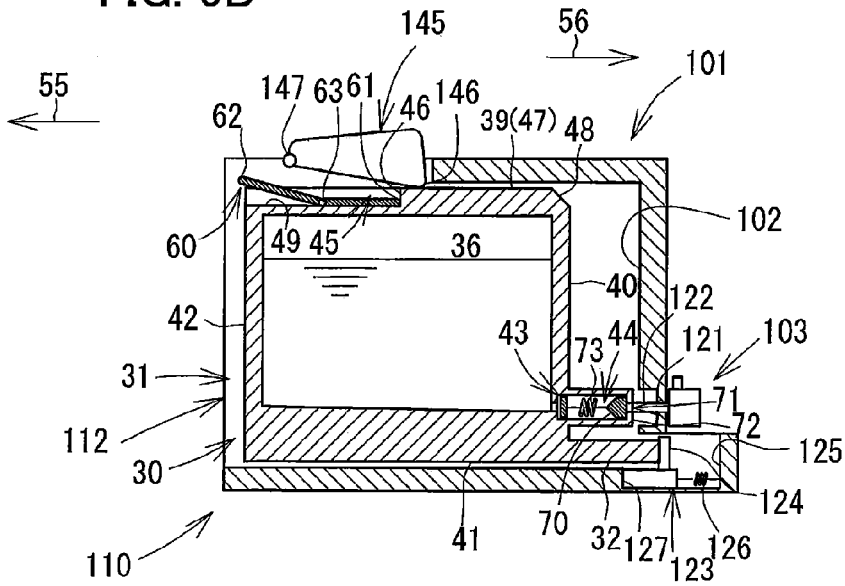
FIG. 5B is a vertical cross-sectional view of the ink cartridge of FIG. 3 mounted on the cartridge mounting unit of FIG. 4, illustrating a state in which the ink cartridge is further being inserted into the cartridge mounting unit after the state of FIG. 5A.

As the ink cartridge 30 is mounted into the cartridge mounting unit 110, the ink supply portion 43 may contact the retaining part 121, and the ink needle 122 may be inserted into the ink supply outlet 71 of the ink supply portion 43, as illustrated in FIG. 5B. At this time, the engaging member 145 is not yet engaged in the engaging recess 45 of the casing 31. The ink needle 122 may be inserted into the ink supply outlet 71 to contact the valve 70. As the ink cartridge 30 may move farther in the insertion direction 56, the valve 70 is pressed by the ink needle 122, moving from its closed position to its open position against the biasing force of the coil spring 73, as illustrated in FIG. 6A. After the ink supply portion 43 is inserted into the retaining part 121 and the ink needle 122 is further inserted into the ink supply outlet 71, the ink cartridge 30 may be mounted in its prescribed position relative to the cartridge mounting unit 110 (mounted position). While not shown in the drawings, an ink inlet is formed on a distal end of the ink needle 122. Accordingly, ink in the ink chamber 36 may flow through the ink channel 44 and into the ink needle 122 via this ink inlet.

When the ink cartridge 30 reaches its mounted position shown in FIG. 6A, the engaging surface 46 formed on the engaging recess 45 of the casing 31 has passed the engaging end 146 of the engaging member 145 in the insertion direction 56. Consequently, since the engaging end 146 of the engaging member 145 is no longer supported on the top surface 47 of the casing 31, the engaging member 145 may pivot clockwise in FIG. 6A into the engaging recess 45, with the engaging end 146 of the engaging member 145 contacting the engaging surface 46. The engaging member 145 may engage in the engaging surface 46 holds the ink cartridge 30 in its mounted position against the biasing forces of the coil spring 73 and coil spring 126. In this state, the top end of the engaging surface 46 is arranged to offset from the first arm 61 in the height direction 52. This completes the operation for mounting the ink cartridge 30 in the cartridge mounting unit 110.

Note that the external force created by the coil spring 126 acts on the protrusion 32 provided on the front wall 40 side of the casing 31. In place of the coil spring 73 used for opening and closing the valve 70, a coil spring may be provided on an outside of the casing 31 as the external force. This coil spring may be positioned such that its distal end may contact the end surface 102 of the cartridge mounting unit 110, a photosensor, or the like, and biases the ink cartridge 30 in the removal direction 55.

In a state where the ink cartridge 30 has been mounted in the cartridge mounting unit 110, the first arm 61 of the pivotal member 60 may be positioned below the engaging end 146 of the engaging member 145, and the second aim 62 of the pivotal member 60 may be apart from the bottom surface 49 of the engaging recess 45 and positioned above the top wall 39 of the casing 31.

When the ink in the ink chamber 36 of the ink cartridge 30 becomes depleted, the user removes the spent ink cartridge 30 from the cartridge mounting unit 110 and mounts a new ink cartridge 30.

Figure 6B:
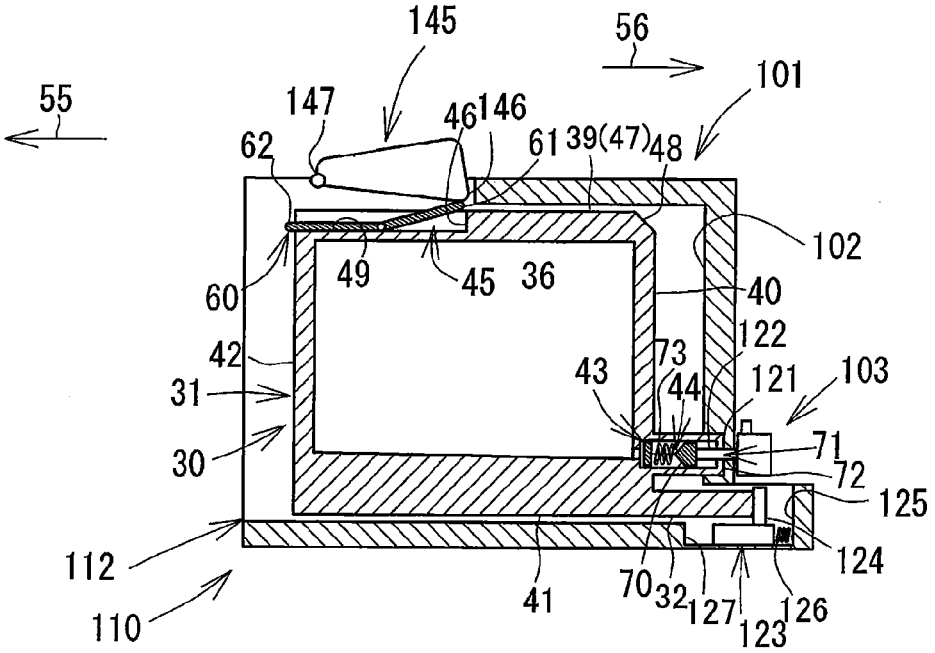
FIG. 6B is a vertical cross-sectional view of the ink cartridge of FIG. 3 mounted on the cartridge mounting unit of FIG. 4, illustrating a state in which the ink cartridge is initially being removed from the cartridge mounting unit.

To remove the ink cartridge 30 from the cartridge mounting unit 110, the user presses the second arm 62 of the pivotal member 60 downward. Since the second arm 62 of the pivotal member 60 is positioned at a downstream of the rear wall 42 in the removal direction 55, the user can operate the pivotal member 60 from the rear wall 42 side of the ink cartridge 30. When the user presses the second arm 62 of the pivotal member 60 downward, the first arm 61 is moved upward to separate from the bottom surface 49 of the engaging recess 45, as illustrated in FIG. 6B. By the movement of the first arm 61 upward, the engaging member 145 may be pushed upward. Through this operation, the engaging member 145 may pivot counterclockwise in FIG. 6B until the engaging end 146 separates from the engaging surface 46. That is, the engaging member 145 may pivotally move from the locked position to the unlocked position, releasing its hold on the ink cartridge 30.

When the engaging end 146 of the engaging member 145 separates from the engaging surface 46, the external forces applied to the casing 31 (specifically, the biasing forces of the coil spring 73 and/or coil spring 126) move the casing 31 in the removal direction 55. However, at this time, the pivotal member 60 is touched by the user. Accordingly, the user's hand absorbs the biasing forces of the coil springs 73 and 126 through the biasing force or its self-weight and pivotal member 60.

<Effects of the Embodiment>

When the user pivots the pivotal member 60, the engagement between the engaging member 145 and the engaging surface 46 is released and the ink cartridge 30 may be moved in the removal direction 55 due to the external force, e.g., the biasing force of the coil spring 73 or 126. However, in the embodiment, the pivotal member 60 for disengaging the engagement between the engaging surface 46 and the engaging member 145 is disposed not at the cartridge mounting unit 110 but at the ink cartridge 30. Therefore, the pivotal member 60 (second arm 62) is contacted by the user's hand when the ink cartridge 30 moves in the removal direction 55, and the user's hand reduces the speed of the ink cartridge 30. As the result, the ink cartridge 30 can be prevented from falling through the opening of the printer 10 when removed from the cartridge mounting unit 110, thereby ink can be prevented from dripping out of the ink needle 122 when the ink cartridge 30 is replaced.

Further, a user-operated member for operating the engaging member 145 need not be provided in the cartridge mounting unit 110, making it possible to produce a more compact printer 10.

Further, the second arm 62 is positioned at a downstream of the first arm 61 in the removal direction 55. Therefore, a user can easily identify whether or not the engaging surface 46 and the engaging member 145 are engaged with each other based on the position of the second arm 62.

The engagement between the ink cartridge 30 and the cartridge mounting unit 110 is performed by the engaging surface 46 and the engaging member 145. The pivotal member 60 is used only to release the engagement between the engaging surface 46 and the engaging member 145. In other words, the pivotal member 60 is separately provided from the engaging surface 46. Therefore, even if the pivotal member 60 is deformed, the engagement between the engaging surface 46 and the engaging member 145 is held.

<Variations of the Embodiments>

While the invention has been described in detail with reference to the embodiments thereof, it would be apparent to those skilled in the art that various changes and modifications may be made therein without departing from the spirit of the invention.

Figure 7:
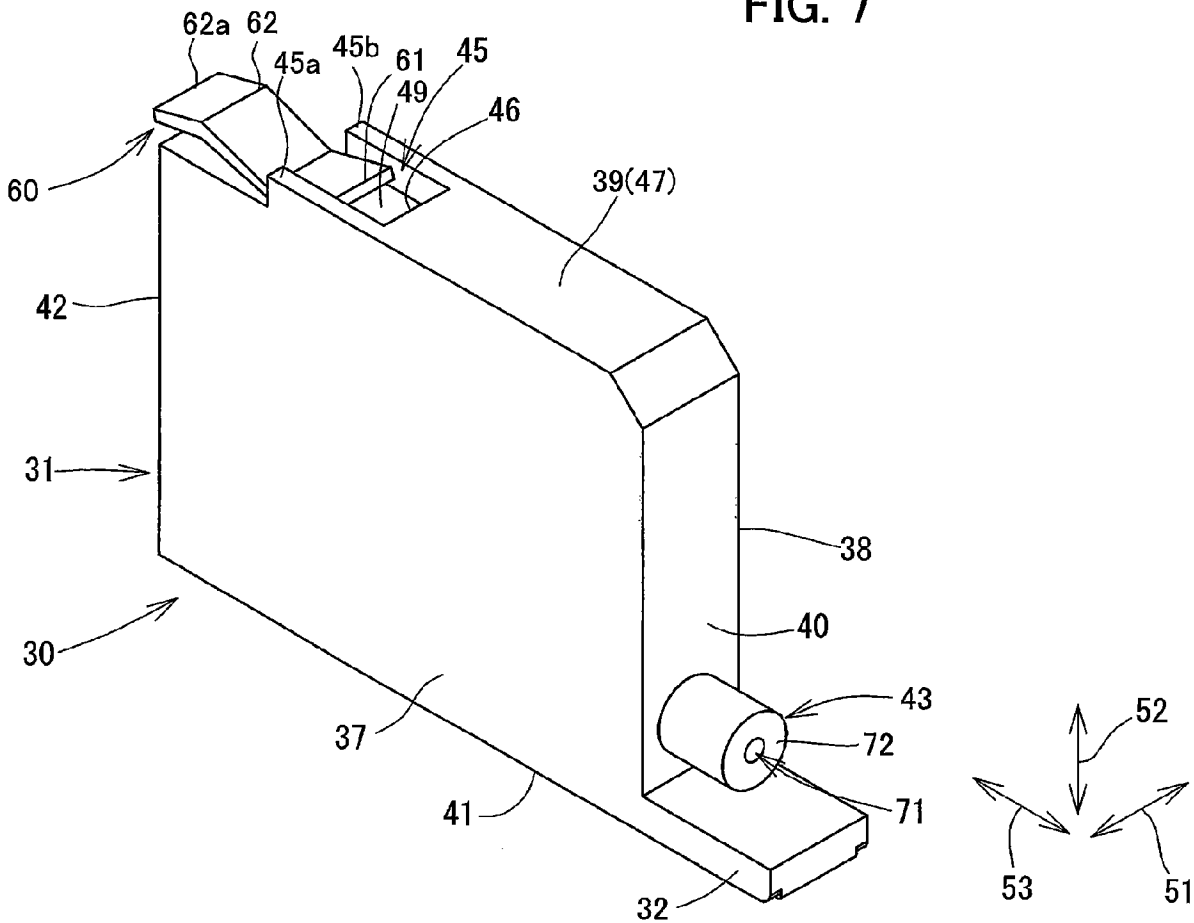
FIG. 7 is a perspective view an ink cartridge according to a first variation of the invention.
Figure 8:
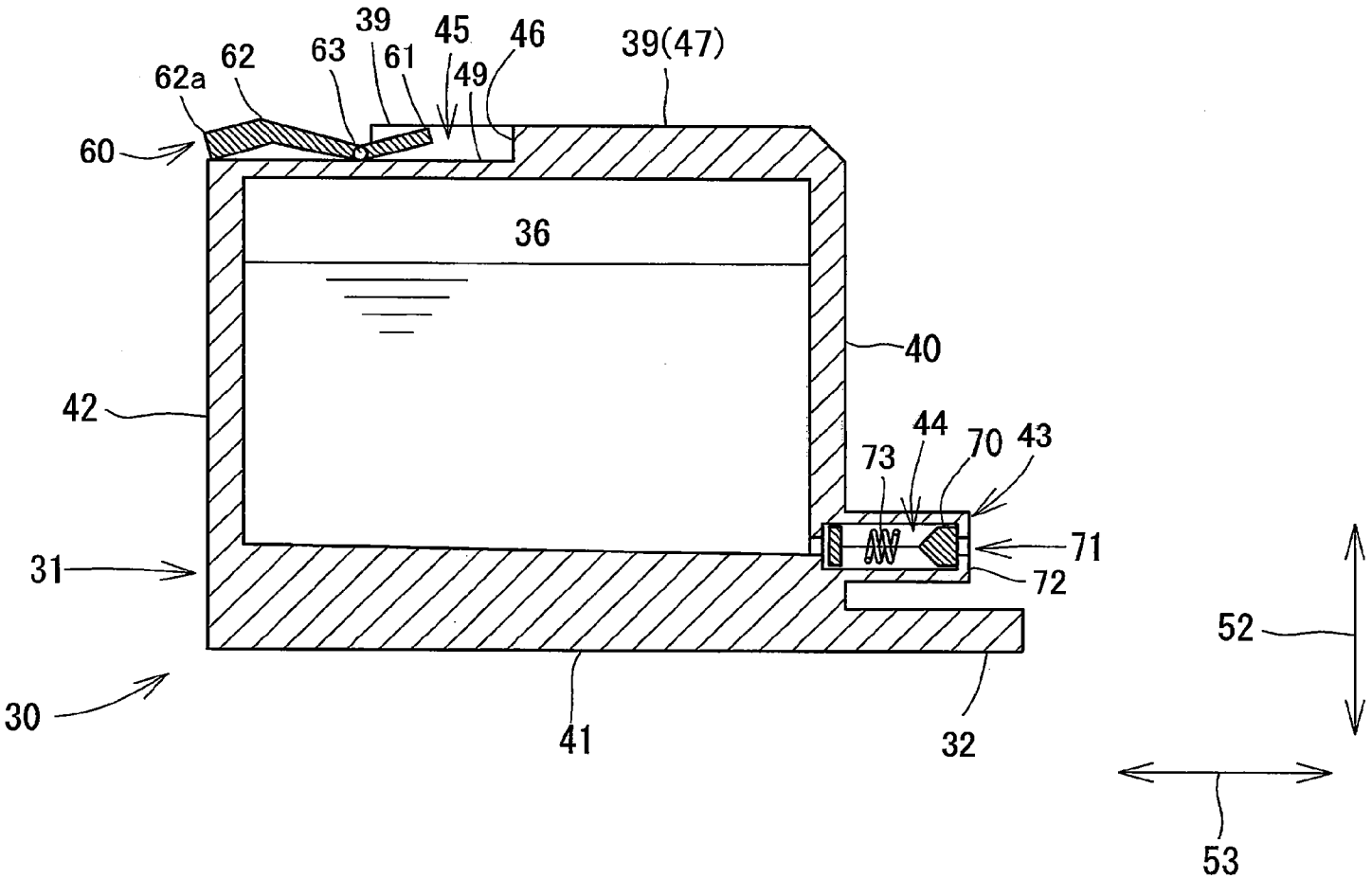
FIG. 8 is a vertical cross-sectional view showing an internal structure of the ink cartridge of FIG. 7.
Figure 9A:
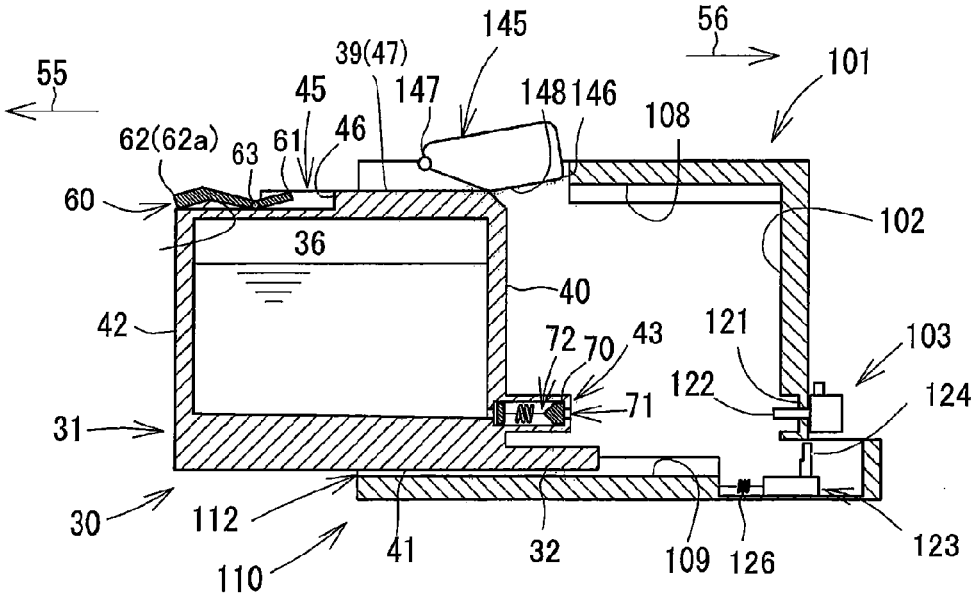
FIG. 9A is a vertical cross-sectional view of the ink cartridge of FIG. 7 mounted in the cartridge mounting unit of FIG. 11, illustrating a state in which the ink cartridge is initially being inserted into the cartridge mounting unit.
Figure 9B:
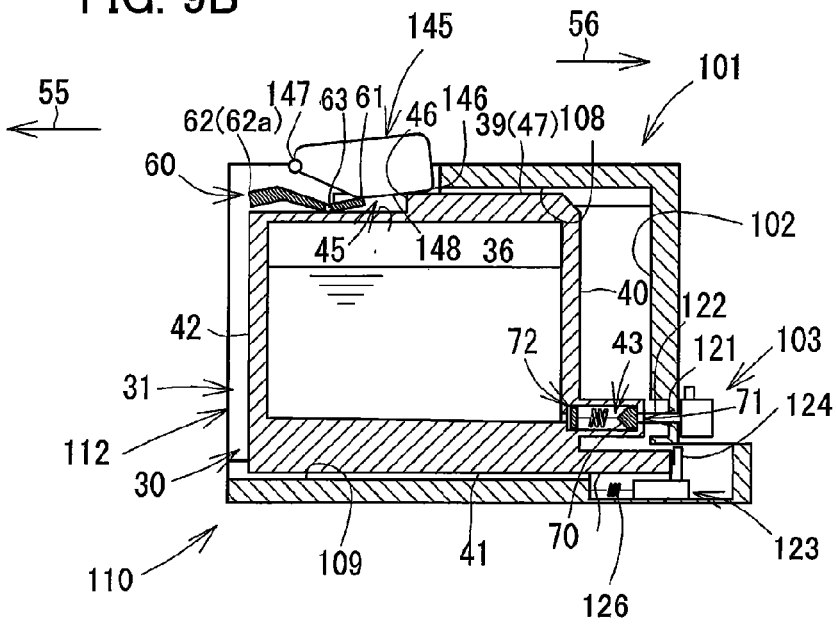
FIG. 9B is a vertical cross-sectional view of the ink cartridge of FIG. 7 mounted in the cartridge mounting unit, illustrating a state in which the ink cartridge is further being inserted into the cartridge mounting unit after the state of FIG. 5A.
Figure 10A:
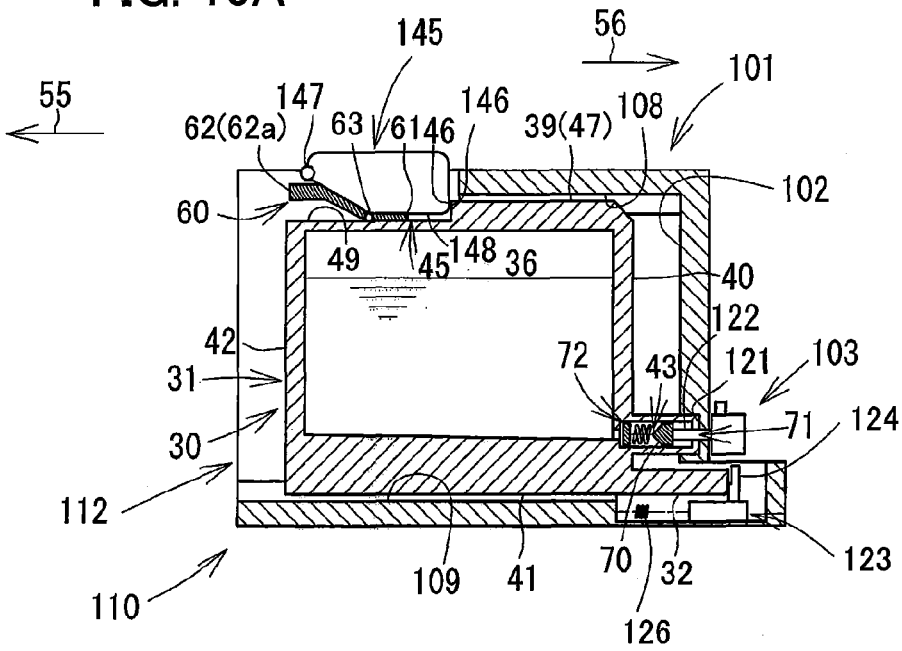
FIG. 10A is a vertical cross-sectional view of the ink cartridge mounted in the cartridge mounting unit, illustrating a state in which the ink cartridge is completely mounted in the cartridge mounting unit.
Figure 10B:
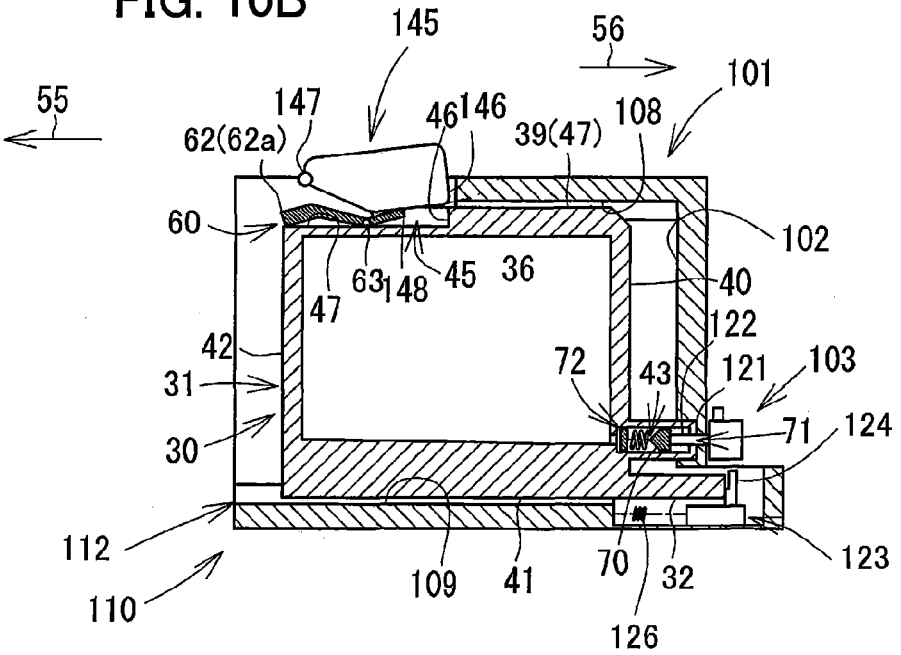
FIG. 10B is a vertical cross-sectional view of the ink cartridge mounted in the cartridge mounting unit, illustrating a state in which the ink cartridge is being removed from the cartridge mounting unit after the state of FIG. 10A.

For example, as shown in FIGS. 7 and 8, the pair of ribs 45*a*, 45*b* may extend in the removal direction 55 from the engaging surface 46 to around the shaft 63.

Further, as shown in FIGS. 8 and 9(A)-10(B), it is preferable that a tip end of the first arm 61 does not protrude beyond the pair of ribs 45*a*, 45*b*.

Further, as shown in FIGS. 7-10(B), the second arm 62 of the pivotal member 60 may be provided with a bent part 62*a* hat is bent downward. The thickness of the second arm 62 (especially, the bent part 62*a*) is greater than the thickness of the first arm 61 to provide a high rigidity.

Figure 11:
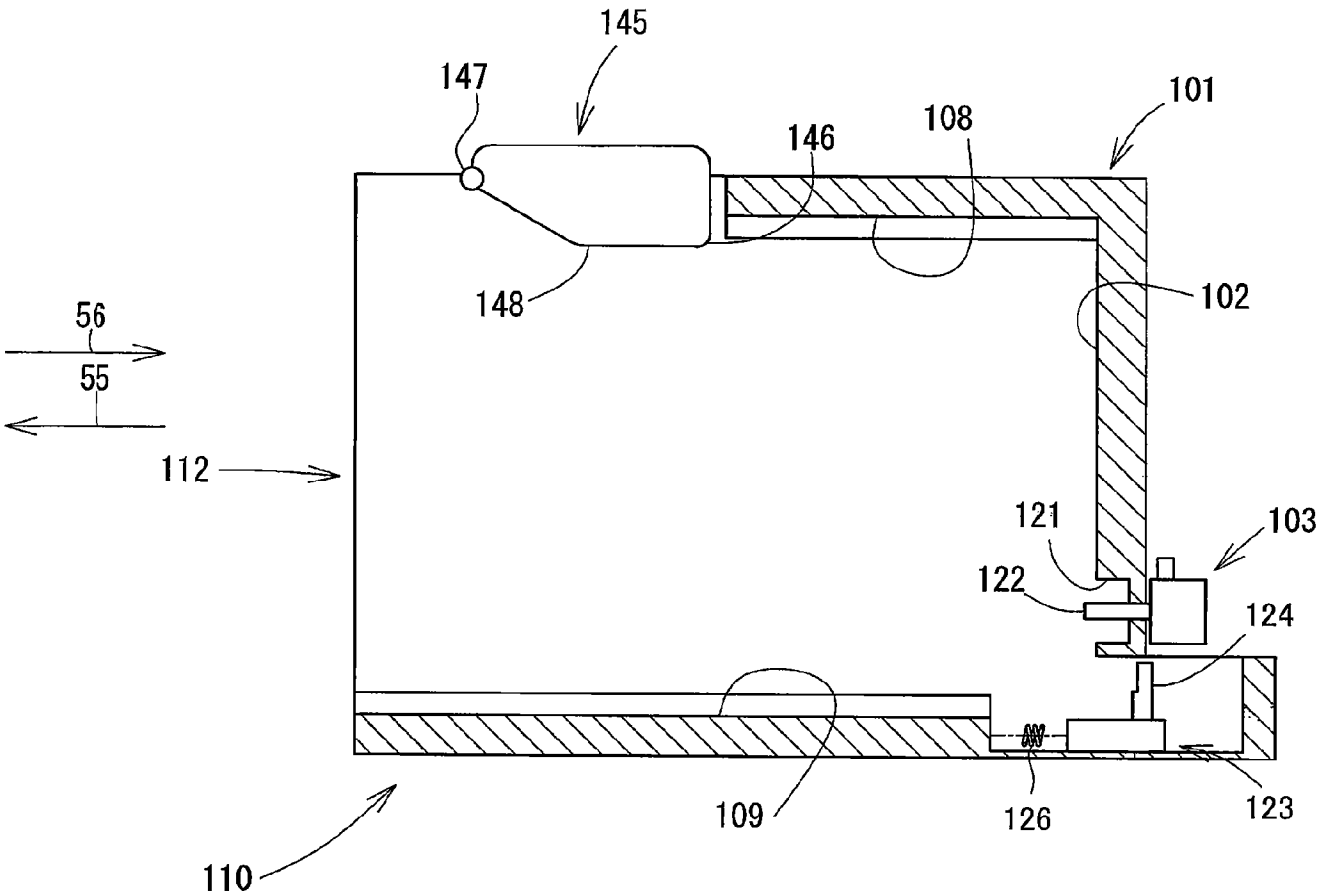
FIG. 11 is a vertical cross-sectional view of the cartridge mounting unit according to the first variation of the present invention.

Further, as shown in FIG. 11, the case 101 may be formed with a first guide groove 108 and a second guide groove 109. The first guide groove 108 extending in the removal direction 55 and insertion direction 56 is formed on the top surface of the case 101, and the second guide groove 109 extending in the removal direction 55 and insertion direction 56 is formed on the bottom surface of the case 101. The pair of ribs 45*a*, 45*b* is guided by the guide groove 108 of the case 101 when the ink cartridge 30 is mounted in the cartridge mounting portion 110. The ink cartridge 30 is guided in the insertion direction 56 by the first guide groove 108 and the pair of the ribs 45*a*, 45*b*. Note that the bottom surface 41 of the casing 31 is guided by the guide groove 109 of the case 101.

Further, an engaging member movable in the upper-lower direction may be used instead of the engaging member 145.

Further, the pivotal member 60 may move the engaging member 145 not directly but via an another member.

In the embodiments described above, the coil springs 73 and 126 apply an external force in the removal direction 55 to the ink cartridge 30 when the ink cartridge 30 is mounted in the cartridge mounting unit 110. In place of the coil springs 73 and 126, a biasing member provided on the ink cartridge 30 may function to apply an external force to the ink cartridge 30 in its mounted state. For example, a coil spring extending in the insertion direction 56 may be provided on the front wall 40 of the casing 31. When the ink cartridge 30 is mounted in the cartridge mounting unit 110, the coil spring contacts the end surface 102 of the case 101 and compresses to apply an external force to the casing 31 in the removal direction 55.

In the embodiments, a detecting portion configured to detect the amount of residual ink in the ink cartridge 30 has been omitted, such a detecting portion may be provided on the ink cartridge 30. The detection portion may be provided on the middle of the front wall 40 of the ink cartridge 30 and protrudes from the front wall 40 in a direction away from the ink chamber 36. The detection portion is formed of a light transmissive resin. The amount of ink in the ink chamber 36 of the ink cartridge 30 may be detected manually by looking into the ink chamber 36 through the detection portion or automatically with a photo sensor. When using a photosensor, the distance between a pair of side walls constituting the detection portion is set smaller than the gap between the light-emitting element and light-receiving element of the photosensor. A light-shielding plate that moves based on the quantity of ink may be provided in the detection portion. Alternatively, the light-shielding plate may be replaced with a device capable of reducing the amount of light that reaches the light-receiving element by reflecting, diffracting, or attenuating all or a portion of the light emitted from the light-emitting element based on the amount of ink in the ink chamber 36.

While the preferred embodiments describe the printing liquid as ink stored in the ink cartridge 30 for use with an inkjet-type printer 10, the printing liquid is not limited to ink. The present invention may also be applied to a cartridge that stores toner as the printing liquid for use in an electrophotographic image-forming apparatus, for example.

What is claimed is:

1. A printing-liquid cartridge comprising:

a print liquid chamber configured to store print liquid;

a print liquid supply portion configured to allow the print liquid to flow out of the print liquid chamber in a fluid outflow direction;

an engaging portion comprising an engaging surface configured to prevent the printing-liquid cartridge from moving in a direction opposite to the fluid outflow direction by contact of the engaging surface with an external object in the direction opposite to the fluid outflow direction; and a release member which is a separate member from the engaging portion and is configured to move relative to the engaging surface between a first position and a second position, wherein the release member is aligned with a lower portion of the engaging surface in the fluid outflow direction when the release member is in the first position and the release member is configured to release the engaging surface from the contact with the external object by moving from the first position to the second position.

2. The printing-liquid cartridge according to claim 1, wherein the release member is not aligned with the lower portion of the engaging surface in the fluid outflow direction when the release member is in the second position.

3. The printing-liquid cartridge according to claim 1, further comprising a lever comprising a first end portion and a second end portion opposite to the first end portion, wherein the first end portion comprises the release member, and wherein the lever is configured to swing around an axis extending in a width direction perpendicular to the fluid outflow direction and positioned between the first end portion and the second end portion.

4. The printing-liquid cartridge according to claim 3, wherein the release member is positioned on or adjacent to the engaging surface in the fluid outflow direction when the release member is in the first position.

5. The printing-liquid cartridge according to claim 3, wherein the release member is positioned away from the engaging surface when the release member is in the second position.

6. The printing-liquid cartridge according to claim 3, wherein the second end portion of the lever is configured to be subject to user's operation for moving the release member from the first position to the second position.

7. The printing-liquid cartridge according to claim 1, further comprising a body having:

a front surface at which the print liquid supply portion is positioned;

a rear surface opposite to the front surface in the fluid outflow direction; and an upper surface extending between upper ends of the front surface and the rear surface, the upper surface having a width in a width direction perpendicular to the fluid outflow direction, wherein the engaging portion and the release member are provided at the upper surface.

8. The printing-liquid cartridge according to claim 7, further comprising a pair of ribs protruding from the upper surface in a height direction perpendicular to the fluid outflow direction and the width direction, wherein the release member is disposed between the pair of ribs in the width direction, and wherein the upper surface and the engaging surface are perpendicular to each other.

9. The printing-liquid cartridge according to claim 7, wherein the release member does not protrude beyond the pair of ribs in the height direction when the release member is in the second position.

10. The printing-liquid cartridge according to claim 7, wherein the engaging surface is positioned further from the rear surface than the release member in the fluid outflow direction.

11. The printing-liquid cartridge according to claim 8, wherein the pair of ribs is guided along a pair of guide members provided in a recording apparatus and extending in the fluid outflow direction during mounting of the printing- liquid cartridge to the recording apparatus.

12. A recording apparatus on which the printing-liquid cartridge according to claim 1 is mountable, the recording apparatus comprising an engaging member configured to contact the engaging surface of the printing-liquid cartridge, wherein the release member is configured to allow the engaging member to move away from the engaging surface when the release member moves from the first position to the second position.

13. The recording apparatus according to claim 12, further comprising a biasing member configured to bias the printing-liquid cartridge in the direction opposite to the fluid outflow direction, wherein the biasing member moves the printing-liquid cartridge in the direction opposite to the fluid outflow direction when the release member is in the second position and the contact of the engaging surface with the engaging member is released.

14. The printing-liquid cartridge according to claim 3, wherein the second end portion is positioned farther from the engaging surface than the first end portion in the direction opposite to the fluid outflow direction.

15. A printing-liquid cartridge mountable in a cartridge mounting portion of a recording apparatus in a first direction, the printing-liquid cartridge comprising:

a casing configured to accommodate print liquid, wherein the casing comprises a liquid-supplying portion configured to be connected to a liquid-supplied portion of the cartridge mounting portion to supply the print liquid to the recording apparatus;

an engaging portion comprising an engaging surface configured to contact an engaging member of the cartridge mounting portion and prevent the printing-liquid cartridge from moving in a direction opposite to the first direction when the printing-liquid cartridge is mounted in the cartridge mounting portion by contact of the engaging surface with the engaging member in the direction opposite to the first direction; and a release member which is a separate member from the engaging portion and is configured to move relative to the engaging surface between a first position and a second position, wherein the release member is aligned with a lower portion of the engaging surface in the first direction when the release member is in the first position, and the release member is configured to release the engaging surface from the contact with the engaging member by moving from the first position to the second position.

16. The printing-liquid cartridge according to claim 15, further comprising a lever, wherein the casing has a first surface extending in both the first direction and a second direction orthogonal to the first direction, and wherein the lever is pivotably provided at the first surface and comprises:

a shaft extending in the second direction;

a first arm radially extending from the shaft and comprising the release member; and a second arm, radially extending from the shaft in a direction different than the first arm extends, and wherein the lever is configured to pivot about the shaft to release the contact of the engaging surface with the engaging member.

17. The printing-liquid cartridge according to claim 16, wherein the first arm is closer to the first surface than the second arm when the release member is in the first position.

18. The printing-liquid cartridge according to claim 17, wherein when the first arm pivots away from the first surface, the release member moves from the first position to the second position, and the contact between the engaging surface and the engaging member is released in accordance with the pivotal movement of the first arm.

19. A recording apparatus on which a printing-liquid cartridge is mountable, the printing-liquid cartridge comprising: a body configured to accommodate print liquid, the body comprising a liquid-supplying portion; an engaging portion comprising an engaging surface; and a release member, the recording apparatus comprising:

a liquid-supplied portion configured to be connected to the liquid-supplying portion, wherein the print liquid is allowed to be supplied to the recording apparatus when the liquid-supplied portion is connected to the liquid-supplying portion;

a biasing member configured to provide an urging force directed to a first direction for detaching the liquid-supplying portion from the liquid-supplied portion when the liquid-supplying portion is connected to the liquid-supplied portion; and an engaging member configured to contact the engaging surface to prevent the printing-liquid cartridge from moving in the first direction against the urging force when the liquid-supplying portion is connected to the liquid-supplied portion, wherein the release member is configured to move the engaging member to release the contact of the engaging member with the engaging surface.

20. The recording apparatus according to claim 19, wherein the engaging member comprises a shaft, wherein the engaging member is configured to pivot about the shaft to selectively move toward and away from the engaging surface.

* * * * *